US008328594B2

(12) United States Patent
Hall

(10) Patent No.: US 8,328,594 B2
(45) Date of Patent: Dec. 11, 2012

(54) INFANT ACCOMODATION APPARATUS

(75) Inventor: Diana Hall, Stockport (GB)

(73) Assignee: James Galt & Company Ltd., Cheshire (GB)

( * ) Notice: Subject to any disclaimer, the term of this patent is extended or adjusted under 35 U.S.C. 154(b) by 161 days.

(21) Appl. No.: 12/311,363

(22) PCT Filed: Oct. 2, 2007

(86) PCT No.: PCT/GB2007/003720

§ 371 (c)(1),
(2), (4) Date: Apr. 9, 2009

(87) PCT Pub. No.: WO2008/040952

PCT Pub. Date: Apr. 10, 2008

(65) Prior Publication Data

US 2010/0029170 A1 Feb. 4, 2010

(30) Foreign Application Priority Data

Oct. 4, 2006 (GB) ..... 0619582.0

(51) Int. Cl.
*A63H 33/00* (2006.01)
*A63H 3/06* (2006.01)

(52) U.S. Cl. ..... 446/227; 446/220; 472/134

(58) Field of Classification Search ..... 446/220, 446/221, 227; 472/134
See application file for complete search history.

(56) References Cited

U.S. PATENT DOCUMENTS 2,498,203 A * 2/1950 Fischer ..... 5/98.3
3,430,271 A 3/1969 Junod-Deile
3,832,799 A 9/1974 Vennola
4,812,153 A * 3/1989 Andrejco et al. ..... 65/415
5,642,750 A * 7/1997 Brown et al. ..... 135/137
5,867,851 A * 2/1999 Mariol et al. ..... 5/99.1
5,930,854 A * 8/1999 O'Neill et al. ..... 5/655
6,044,505 A * 4/2000 Friedman ..... 5/631

(Continued)

FOREIGN PATENT DOCUMENTS

FR 2 353 252 A 12/1977

(Continued)

OTHER PUBLICATIONS

International Search Report; PCT/GB2007/003720; filed Feb. 10, 2007 (3 pgs).

(Continued)

*Primary Examiner* — Sarah B McPartlin
(74) *Attorney, Agent, or Firm* — Nixon & Vanderhye

(57) ABSTRACT

Infant accommodation apparatus supported in normal use on a flat horizontal surface. The apparatus includes a support device having, in a vertical plane, a constant circular or oval-shaped cross-section along its extent. The support device has an inner enclosure wall which is an inwardly facing upstanding enclosure wall which defines an infant accommodation region in which an infant may be positioned in use. The inner enclosure wall is endless and defines an endless non-circular enclosure around the infant accommodation region. The maximum diameter of the infant accommodation region is in the range 20 to 50cm, and the inner enclosure wall includes, when viewed from above, three curved apex regions separated by curved side regions. The support device further includes an outer enclosure wall which is an outwardly facing upstanding enclosure wall. The outer enclosure wall, when viewed from above, is non-circular and symmetrical about each of three vertical planes angled at 120° to each other.

2 Claims, 11 Drawing Sheets

U.S. PATENT DOCUMENTS

2005/0181701 A1 8/2005 Cheng et al.

FOREIGN PATENT DOCUMENTS

| | | | |
|---|---|---|---|
| GB | 1126145 | | 9/1968 |
| GB | 2 299 268 | A | 10/1996 |
| GB | 2 318 050 | A | 10/1996 |
| GB | 2 348 130 | A | 9/2000 |
| WO | WO 02/28232 | A1 | 4/2002 |

OTHER PUBLICATIONS

U.K. Search Report under Section 17(5); Application No. GB0719190.1, dated Jan. 22, 2008 (4 pgs).

* cited by examiner

INFANT ACCOMODATION APPARATUS

This application is the U.S. National Phase of International Application

PCT/GB2007/003720, filed Oct. 2, 2007, which designated the U.S. PCT/GB2007/003720 claims priority to British Application No. 0619582.0 filed Oct. 2, 2006. The entire content of these applications are incorporated herein by reference.

This invention relates to infant accommodation apparatus. Numerous types of apparatus for accommodating and/or entertaining infants are known. For example, playpens comprise an enclosure wall supported on the floor within which an infant is placed. Another known apparatus comprises a pair of soft foam semi-circles secured together in order to define a circular area for accommodating an infant.

BACKGROUND OF THE INVENTION

GB2284546 describes an apparatus which comprises an inflatable annular body within which an infant can be accommodated. GB2318050 describes an apparatus which comprises an inflatable annular body and a frame means extending above the annular body for stimulating an infant positioned within the inflatable annular body.

There are problems associated with the inflatable annular body described in the aforementioned document. For example, it has a large volume which is costly to produce because it uses a large amount of plastics material to define the inflatable member; and, furthermore, it takes a relatively long time to inflate, particularly if it is "blown up" manually by a person.

Additionally, the annular body provides little lateral support for an infant positioned within it and, consequently, the infant could roll over in some circumstances if it moves.

The frame means of GB2318050 is difficult to assemble and is relatively weak. Consequently, there is a risk of inadvertent collapse in use. Furthermore, only relatively light stimulating means can be suspended from a few predetermined positions on the frame means.

SUMMARY OF THE INVENTION

It is an object of the present invention to address problems associated with known infant accommodation apparatus.

According to a first aspect of the invention, there is provided infant accommodation apparatus comprising a support device which includes an inwardly facing non-circular upstanding enclosure wall (hereinafter referred to as the "inner enclosure wall") which surrounds an infant accommodation region in which an infant may be positioned in use.

Said inner enclosure wall is preferably resilient and/or cushioning and/or deformable. Said wall may be defined by a foam member, but preferably is defined by means of an inflated member which inflated member can preferably be deflated.

Said support device preferably includes an outer surface provided in a multiplicity of colours. Tactile sense stimulation means and/or auditory sense stimulation means may be associated with said surface.

Said inner enclosure wall is preferably endless, suitably for defining an endless enclosure around the infant accommodation region.

Said inner enclosure wall is preferably curved to define a curved infant accommodation region. That is, said inner enclosure wall suitably curves in a horizontal plane (which plane is suitably parallel to a flat surface, for example a floor, on which the apparatus may be supported in normal use).

Said inner enclosure wall preferably includes a first region which has a smaller radius of curvature than respective second and third regions of said inner enclosure wall adjacent to said first region. Said inner enclosure wall preferably includes a fourth region which is adjacent said second region, wherein said fourth region has a radius of curvature which is less than that of said second region. Said inner enclosure wall preferably includes a fifth region which is adjacent said third region, wherein said fifth region has a radius of curvature which is less than that of said third region. Said enclosure wall preferably has a sixth region between said fourth and fifth regions, wherein said sixth region has a radius of curvature which is greater than the radius of curvature of said fourth and fifth regions.

When said inner enclosure wall includes first, fourth and fifth regions, the radii of curvature of said regions are preferably substantially the same. Preferably, the lengths of said first, fourth and fifth regions are substantially the same. The radii of curvature of each of said first, fourth and fifth regions are preferably less than the radii of curvature of each of said second, third and sixth regions.

When said inner enclosure wall includes second, third and sixth regions, the radii of curvature of said regions are preferably substantially the same. Preferably, the lengths of said second, third and sixth regions are substantially the same. The radii of curvature of each of said second, third and sixth regions are preferably greater than the radii of curvature of each of said first, fourth and fifth regions.

Said inner enclosure wall is preferably substantially symmetrical about each of three vertical planes angled at 120° to each other.

Said inner enclosure wall is preferably substantially in the shape of a modified triangle, for example a modified equilateral triangle. The wall suitable includes three curved apex regions (which are suitably said first, fourth and fifth regions described) separated by curved side regions (which are suitably said second, third and sixth regions described).

The maximum diameter of the inner enclosure wall may be in the range 20 to 50 cm, preferably 25 to 40 cm, more preferably 30 to 40 cm.

Said support device suitably includes an outwardly facing non-circular upstanding enclosure wall (hereinafter referred to as the "outer enclosure wall").

Said outer enclosure wall is preferably endless, suitably for defining an endless outer wall of the support device.

Said outer enclosure wall is preferably curved to define a curved outer wall of the support device. That is, said outer enclosure wall suitably curves in a horizontal plane (which plane is suitably parallel to a flat surface, for example a floor, in which the apparatus may be supported in normal use).

Said outer enclosure wall preferably includes a first region which has a smaller radius of curvature than respective second and third regions of said outer enclosure wall adjacent to said first region. Said outer enclosure wall preferably includes a fourth region which is adjacent said second region, wherein said fourth region has a radius of curvature which is less than that of said second region. Said enclosure wall preferably includes a fifth region which is adjacent said third region, wherein said fifth region has a radius of curvature which is less than that of said third region. Said outer enclosure wall preferably has a sixth region between said fourth and fifth regions, wherein said sixth region has a radius of curvature which is greater than the radius of curvature of said fourth and fifth regions.

When said outer enclosure wall includes first, fourth and fifth regions, the radii of curvature of said regions are preferably substantially the same. Preferably, the lengths of said first, fourth and fifth regions are substantially the same. The radii of curvature of each of said first, fourth and fifth regions of said outer enclosure wall are preferably less than the radii of curvature of each of said second, third and sixth regions.

When said outer enclosure wall includes second, third and sixth regions, the radii of curvature of said regions are preferably substantially the same. Preferably, the lengths of said second, third and sixth regions are substantially the same. The radii of curvature of each of said second, third and sixth regions are preferably greater than the radii of curvature of each of said first, fourth and fifth regions.

Said outer enclosure wall is preferably substantially symmetrical about each of three vertical planes angled at 120° to each other.

Said outer enclosure wall is preferably substantially in the shape of a modified triangle, for example a modified equilateral triangle. The outer wall suitable includes three curved apex regions (which are suitably said first, fourth and fifth regions described) separated by curved side regions (which are suitably said second, third and sixth regions described).

Said inner and outer enclosure walls preferably extend substantially parallel to one another across substantially their entire extent.

Said support device preferably has a substantially constant cross-section (suitably the cross-section in a vertical plane) along its extent. Said cross-section is preferably curved; it is preferably substantially circular or oval-shaped.

Said support device preferably has first and second maximum diameters (i.e. the two largest distances across the support device) which extend in respective first and second directions in a horizontal direction, wherein said first and second directions extend at an angle in the range 95 to 145°, preferably 110 to 130°, especially about 120°, to one another. Said support device preferably has a third maximum diameter (i.e. the third largest distance) which extends in a third direction, wherein said third direction extends at an angle in the range 95 to 145°, preferably 110 to 130°, especially about 120°, to each of said first and second directions.

Said first maximum diameter may be in the range 70 to 100 cm, preferably 75 to 95 cm. Said second maximum diameter may be in the range 70 to 100 cm, preferably 75 to 95 cm. Said third maximum diameter may be in the range 70 to 100 cm, preferably 75 to 95 cm.

The support device may have a maximum height in the range 10 to 35 cm, preferably 15 to 30 cm.

The support device may be arranged to define a first condition. In said first condition, said support device may have a first volume. In this case, said support device is preferably relatively rigid. Preferably, also, said support device is cushioning and/or deformable when in said condition. The device may be arranged to define a second condition. In said second condition, said support device may have a second volume. Said second volume is preferably less than said first volume. Said second volume suitably represents the minimum volume of said support device. Said second condition of the device suitably represents a storage condition of the device. The device may be arranged to define a third condition. In said third condition, said support device may have a third volume. Said third volume is preferably greater than said second volume and/or less than said first volume. When in said third condition, said support device is suitably less rigid than when the device is in said first condition. Also, said support device is preferably cushioning and/or deformable.

When the device is in said first condition, it may be inflated to 80%-100%, for example up to 95%, of its maximum volume. When the device is in said second condition, it is preferably substantially deflated. When in said third condition, it may be inflated to 40%-79.99% of its maximum volume.

Said support means preferably incorporates a cover means which is preferably removable from an insert member of device. Said insert member preferably provides the resilient and/or cushioning and/or deformable properties of the support device. Said insert member is preferably an inflated or inflatable member. Said insert member preferably independently includes the features of said support device (e.g. of said inner and outer walls thereof) as described above.

Said cover means is preferably arranged to cover substantially the whole of said insert member. Said cover means is preferably flexible. Said cover means is preferably non-self-supporting. The cover means is preferably made out of a fabric which is preferably washable.

Said cover means preferably has an internal region in which the insert member is accommodated. A cover opening is suitably provided in said cover means for allowing access to said internal region. Closure means, for example in the form of a zip fastener, may be provided for closing said cover opening.

Said infant accommodation apparatus may include a frame means extending above the support device for visually stimulating an infant positioned in the infant accommodation region.

The top of said frame means may extend above the support device to a position which is spaced from said support device by a distance which is greater preferably by a factor of at least two, more preferably at least three, than the height of said support device.

Said frame means preferably includes at least two, more preferably at least three, limbs extending upwardly from said support device. Each of said limbs is preferably curved and preferably extends to an apex region of the frame means which apex region is preferably positioned substantially centrally above the support device. Each of said limbs is suitably positioned outside the periphery of the support device. Each limb preferably abuts a region, preferably a curved region, of the support device.

When said support device includes an outer enclosure wall having first, second and third regions, a first limb of said frame means is preferably positioned directly opposite part of said second region and preferably abuts it. Another limb may be positioned directly opposite part of said second region and preferably abuts it. Preferably no limb is opposite said first region.

When said support device includes an outer enclosure wall having first, second, third, fourth, fifth and sixth regions, preferably a first limb of said frame means is arranged opposite part of said second region, and preferably abuts it, a second limb of said frame means is arranged opposite part of said third region and preferably abuts it and a third limb of said frame means is arranged opposite a part of said sixth region and preferably abuts it. Preferably, no limb is opposite part of said first, fourth or fifth regions.

Said frame means is preferably self-supporting and arranged to be free-standing. Each limb of said frame means is preferably rigid. Each is preferably made from a plastics material. Each limb may comprise, at one end, a securement means for releasably securing the end in a fixed position relative to ends of other limbs. Said securement means may be cooperable with a securement boss. One of either the securements means or boss may comprise a male element which is arranged to releasably engage a female element provided on the other one of either the securement means or boss. Preferably the boss defines a plurality of female elements arranged to be engaged by male elements associated with said limbs. Said boss may include a securement member for securing the limbs in position. Said securement member may comprise a screw threaded member which is arranged to be releasably secure the limbs in position.

Said frame is preferably in the form of a tripod, having legs which curve on moving inwards and upwards.

Said frame means preferably includes means for securing, preferably releasably securing, stimulation means, suitably in the form of toys. One of said stimulation means is preferably a mirror. Another may be in the form of an electronic device. Such an electronic device may comprise a lights and/or sounds producing device. Said means for securing may comprise male or female elements arranged to cooperate with the other one of a male or female element associated with said stimulation means.

A preferred means for securing may be arranged to extend around said frame means and provide a means for suspending stimulation means, for example toys, therefrom. Said means for securing may comprise a collar arranged to be movable from a first open position wherein it may be engaged with the frame means and a second position wherein it is secured to the frame means. Said collar is preferably flexible; it may be made from a fabric. Said collar preferably includes respective openings which are arranged to be engaged by an engagement member to secure parts of the collar together and therefore secure it in said second position. Said engagement member may also be arranged for releasably securing stimulation means. Said engagement means may comprise a hook which is arranged to both secure parts of the collar together and releasably engage stimulation means.

Two or more, preferably three or more means for securing (e.g. collars) as described may be provided and arranged to support respective stimulation means in position.

In a preferred embodiment, the means for securing (e.g. a collar as described) is arranged to frictionally engage the frame means and be held against downward movement under gravity by a frictional force existing between said means for securing and the frame means.

The invention extends to an infant accommodation apparatus comprising a support device which includes an upstanding enclosure wall which surrounds an infant accommodation region in which an infant may be positioned in use, wherein said apparatus includes any feature of said device of said first aspect.

The invention extends to a method of assembling an infant accommodation apparatus which comprises providing a frame means above a support device which includes an upstanding enclosure wall which surrounds an infant accommodation in which an infant may be positioned in use.

The invention extends to a kit for assembly of an accommodation apparatus or for use in the method described, the kit comprising means for defining a support device and, optionally, means for defining a frame means.

Any feature of any aspect of any invention or embodiment described herein may be combined with any feature of any aspect of any other invention or embodiment described herein mutatis mutandis.

BRIEF DESCRIPTION OF THE DRAWINGS

Specific embodiments of the invention will now be described, by way of example, with reference to the accompanying drawings, in which.

DESCRIPTION OF PREFERRED EMBODIMENTS

Figure 1:
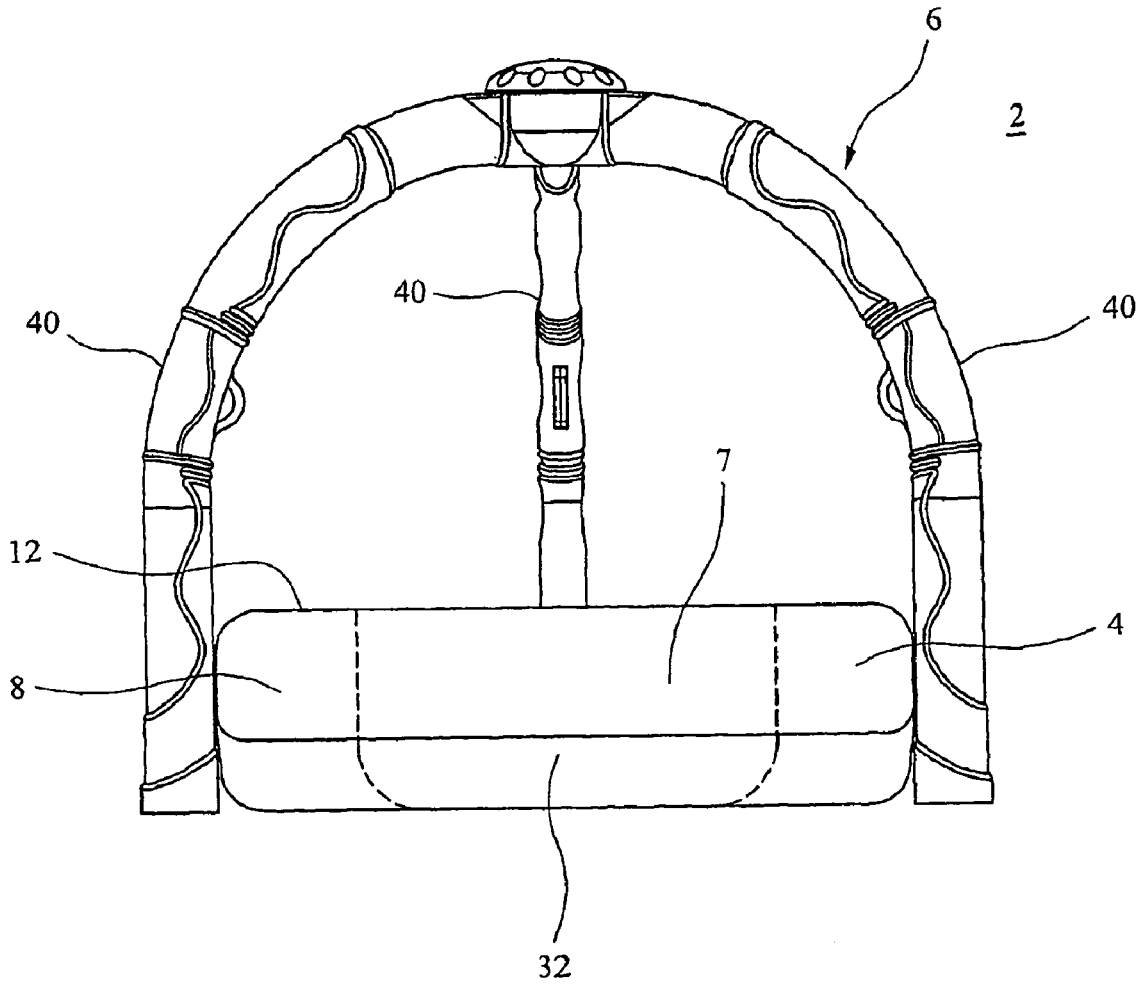
FIG. 1 is a side view of an infant accommodation apparatus.

The infant accommodation apparatus 2 comprises an inflatable support device 4 and a framework 6 which abuts and extends over the device 4 and includes toys (not shown) arranged to stimulate, for example to visually stimulate, an infant accommodated within an accommodation region 7 of the device.

The apparatus 2 is described in greater detail below.

The support device 4 comprises an inner inflatable plastics member 8 and an outer removable fabric cover 12 which is arranged to completely enclose the member 8. The support device incorporates a padded base part 14 upon which the infant may lie, kneel or sit when the accommodation region 7.

Figure 3:
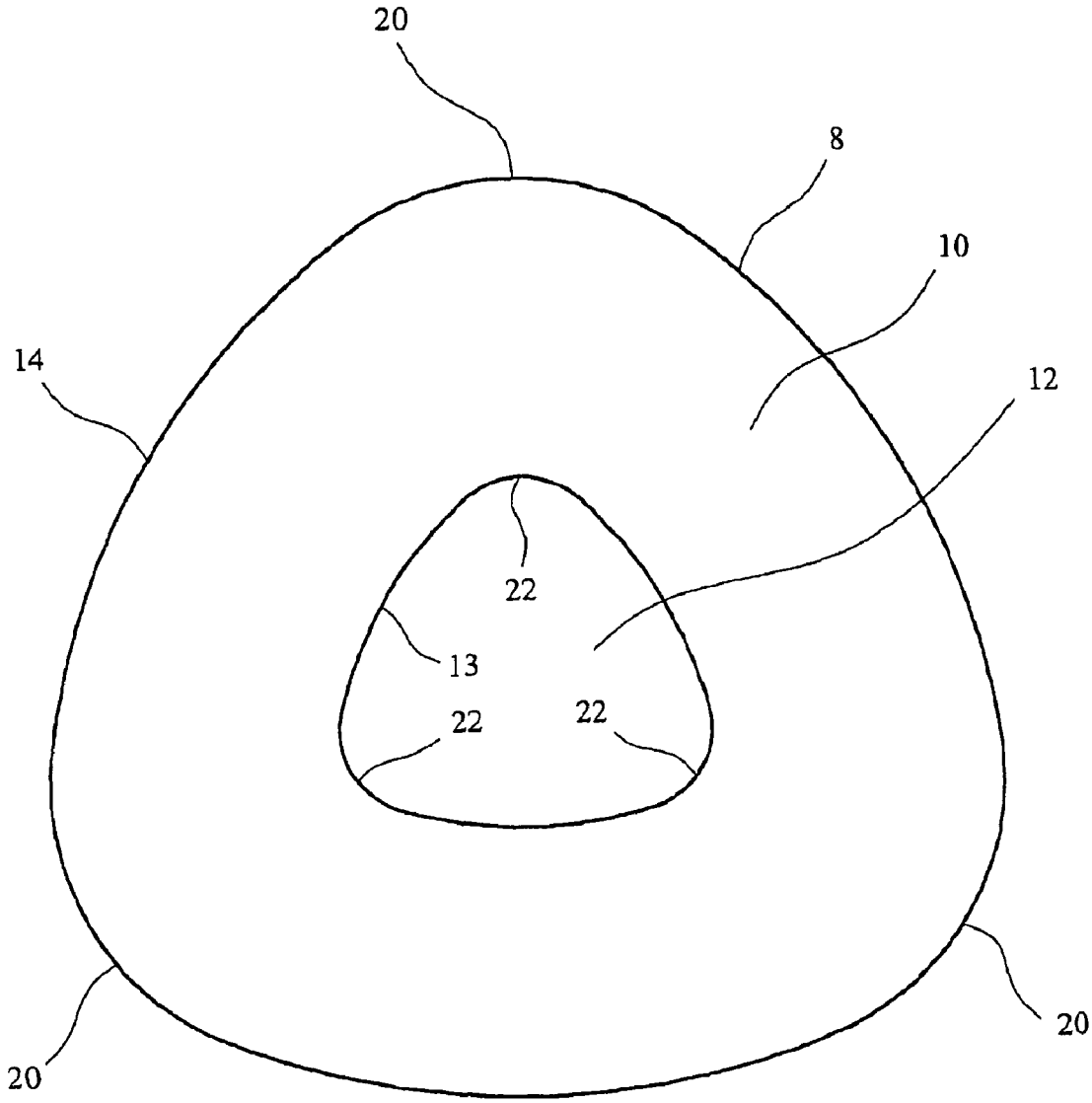
FIG. 3 is a top plan view of an inflatable plastics member when in a deflated state.
Figure 6:
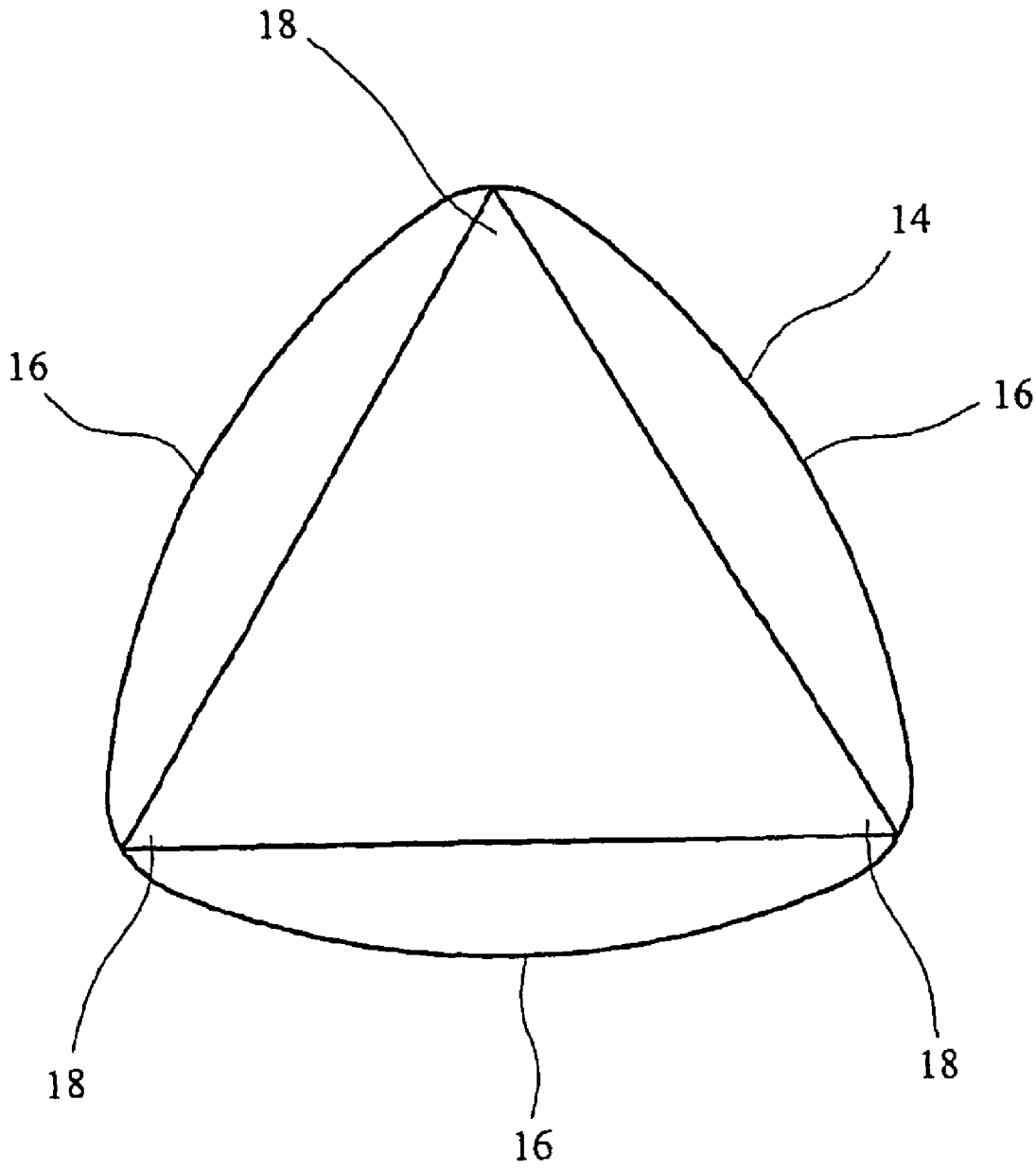
FIG. 6 is a plan view relating the shape of the outer periphery of the plastics member to an equilateral triangle.

Referring to FIG. 3, the plastics member 8 includes an enclosure wall 10 which defines an opening 12 which, when member 8 is inflated, define the infant accommodation region 7. The enclosure wall 10 has respective parallel inner and outer walls 13, 14 in the shape of modified equilateral triangles. This is illustrated in FIG. 6 wherein three convex arcs 16 are shown extending between adjacent apexes 18 of an equilateral triangular in order to form the shape of the outer wall 15. Thus, outer wall 14 of the member 8 may be regarded as being of a modified triangular shape having three curved apex regions 20 each of which has a radius of curvature which is less than the radius of curvature of the outer wall at positions between the apex regions 20. The inner wall 13 corresponds in shape to that of the outer wall 14 and so the opening 12 defined by the inner wall 13 comprises three regions 22 having a radius of curvature which is less than the radius of curvature of regions of the opening between the apex regions.

Figure 7:
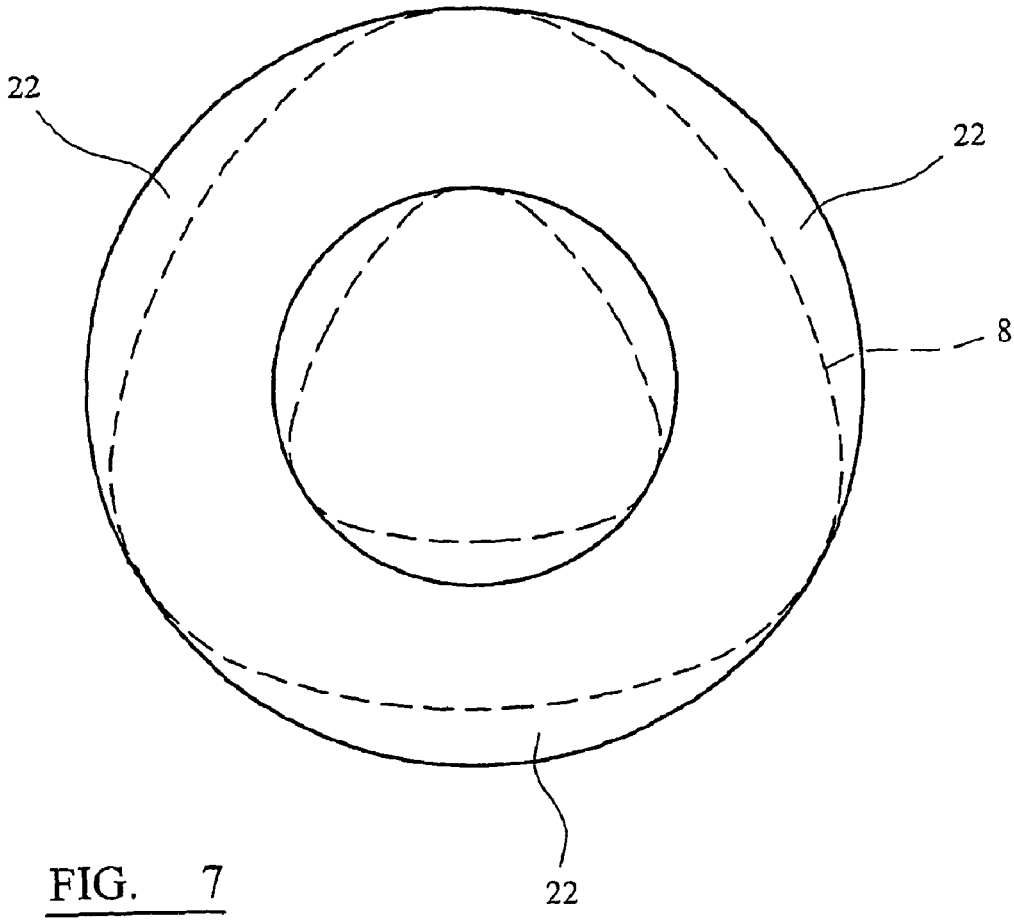
FIG. 7 is a plan view showing in dashed lines the plastics member of FIG. 3 superimposed on a circular member.

The shape of the plastics member 8 (and consequently the infant accommodation region 7) leads to several advantages described herein. One of these is that it can be made using less plastics material and has a lower volume when inflated compared to an equivalent ring shaped plastic member, for example of the type described in GB231805A and GB2284546B. This is illustrated in FIG. 7 wherein the plastics member 8 of FIG. 3 in a deflated state is shown superimposed upon a ring-shaped member having a maximum diameter which is the same as the plastics member. It will be noted that member 8 does not include three areas 22 and it will therefore be appreciated that this leads to provides a significant reduction in the area of plastics material needed to make member 8 and also the volume of air needed to inflate it, compared to the ring-shaped member.

The plastics member 8 is preferably made from a plastics material which does not contain phthalates.

Figure 4:
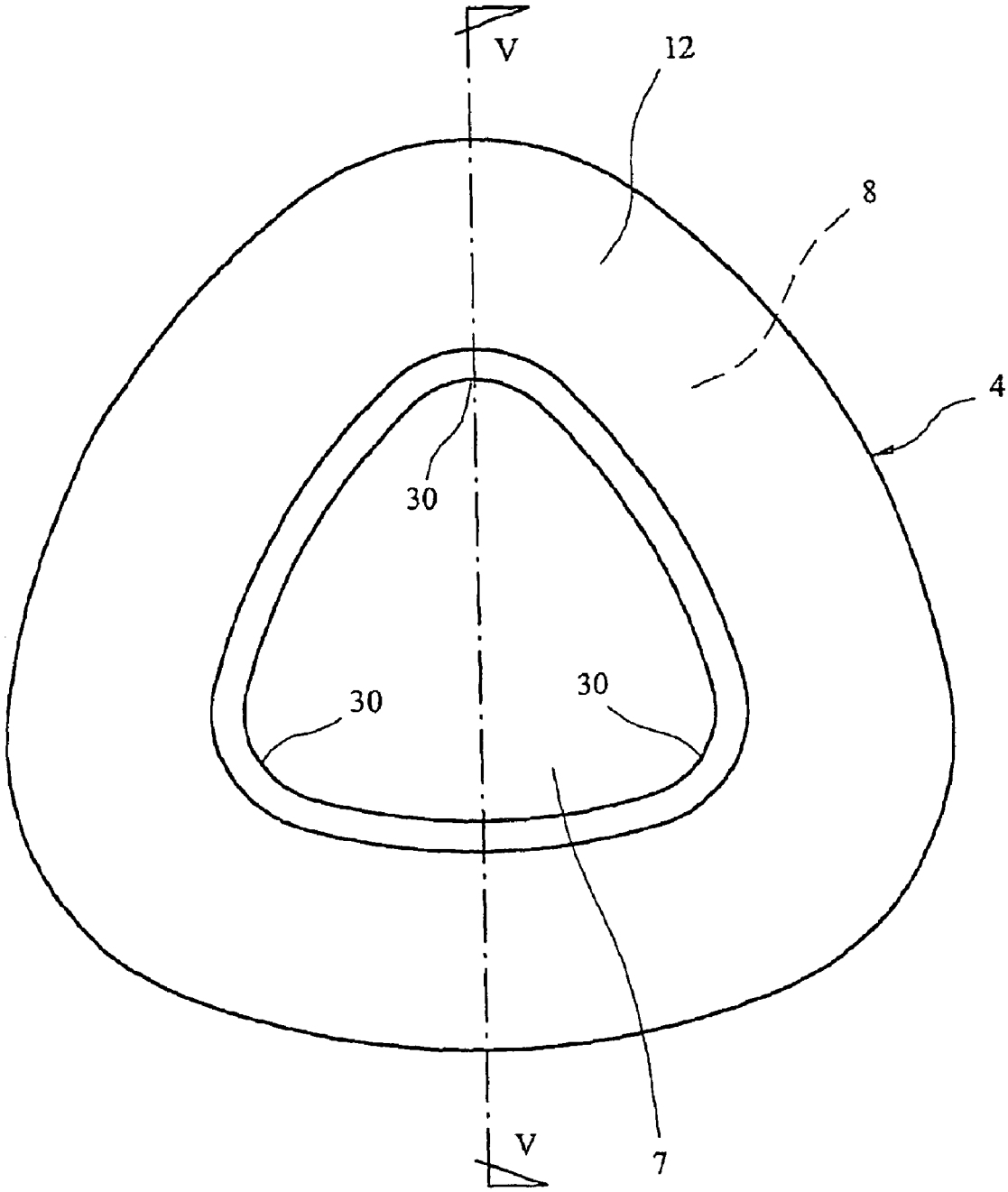
FIG. 4 is a top plan view of a support device which comprises an inflatable plastics member in an inflated state within a fabric cover.
Figure 5:
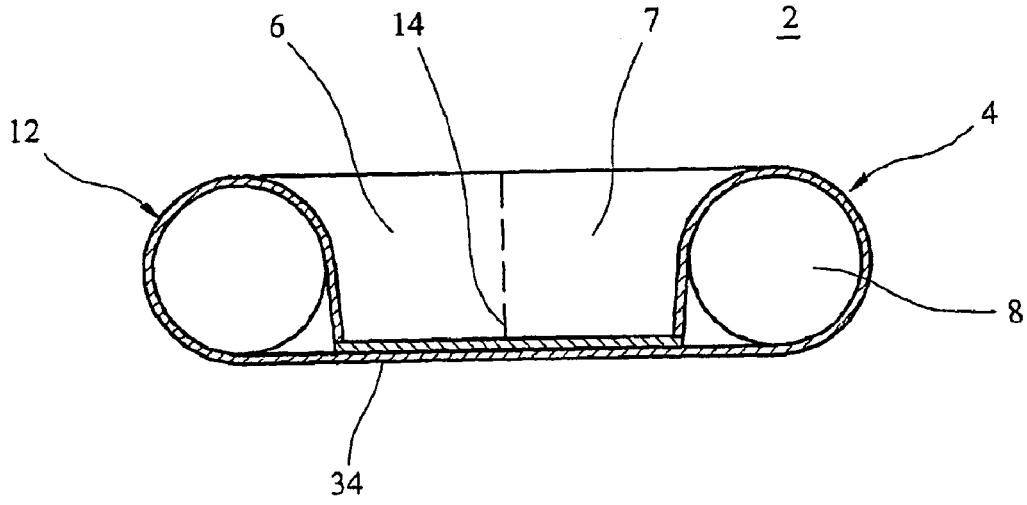
FIG. 5 is a cross-section along line V-V of FIG. 4.

The fabric cover 12 is shaped to snugly receive the plastics member 8 so that when the member 8 is arranged within it the shape of the support device 4 substantially corresponds to that of the plastic member 8, as shown in FIGS. 4 and 5. Thus, the region 7 is in the shape of a modified equilateral triangle with apex regions 30 having a lower radius of curvature compared to the radius of curvature of regions between the apex regions.

The cover 12 includes a zip 32 (FIG. 1) arranged to define an opening through which the plastics member 8, in a deflated state, may be inserted for engagement with the cover. The member 8 may then be inflated to define the arrangement of FIG. 1. It should be appreciated that the padded base 14 of FIG. 7 is not secured to the underlying fabric 34 so that the plastic member 8 can pass between base 14 and fabric 34 when it is being positioned within the cover.

When assembled, the support device 4 defines a safe, supportive environment for an infant which may be positioned with its head/shoulders resting upon one of apex regions 30 and its torso/legs being positioned generally within accommodation region 7. It is found that the arrangement of the apex regions 30 with lower radii of curvature helps laterally support the infant's head and/or shoulders and so the infant is held more stably by the support device in comparison to similar ring-shaped devices.

The inflatable support device 4 may be used as a stand alone device for accommodating an infant or may be used in conjunction with the framework 6.

Figure 8:
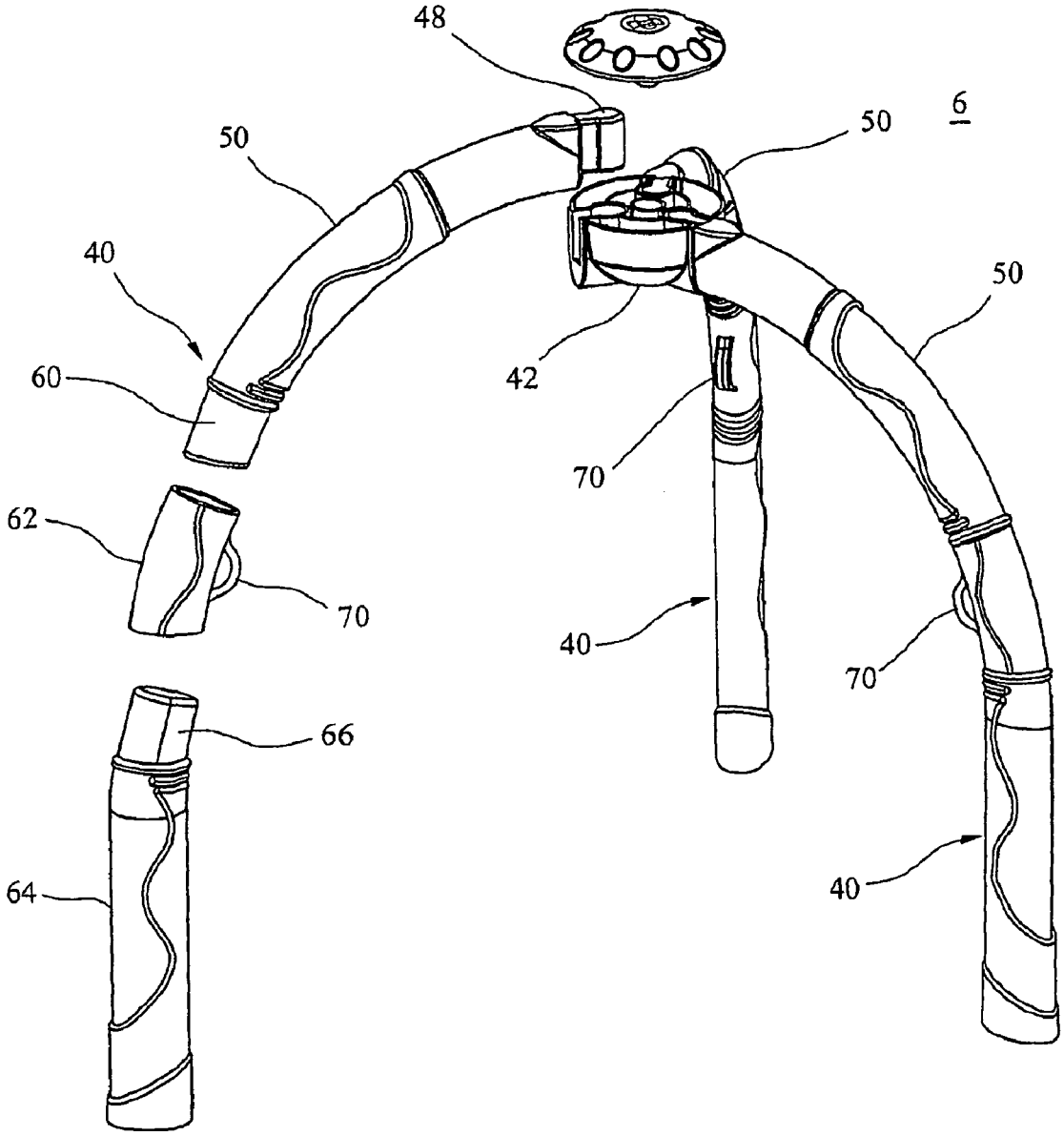
FIG. 8 is a partially exploded perspective view of a framework of the infant accommodation apparatus.
Figure 9:
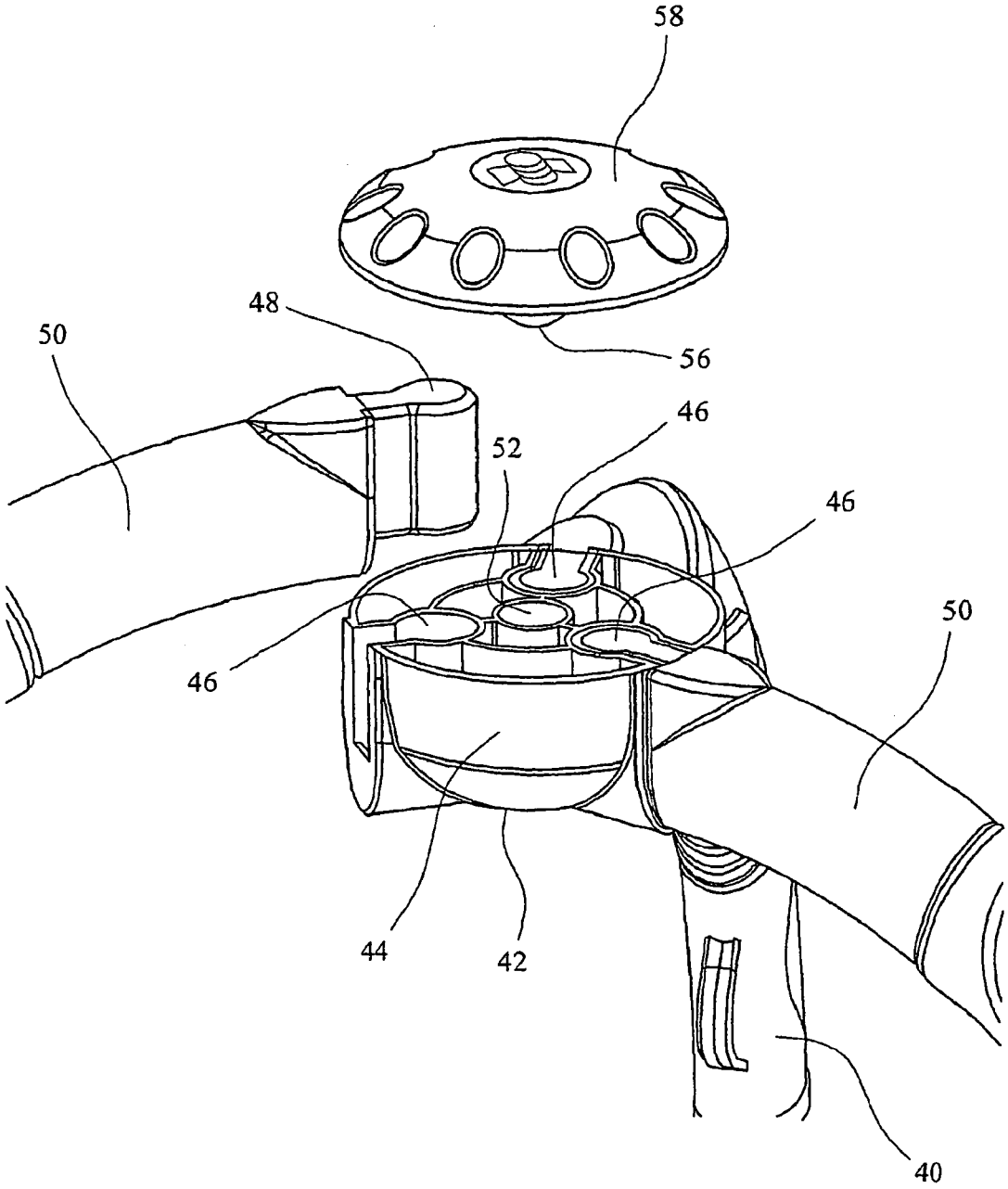
FIG. 9 is a view of a part of the view of FIG. 8 on an enlarged scale.
Figure 10:
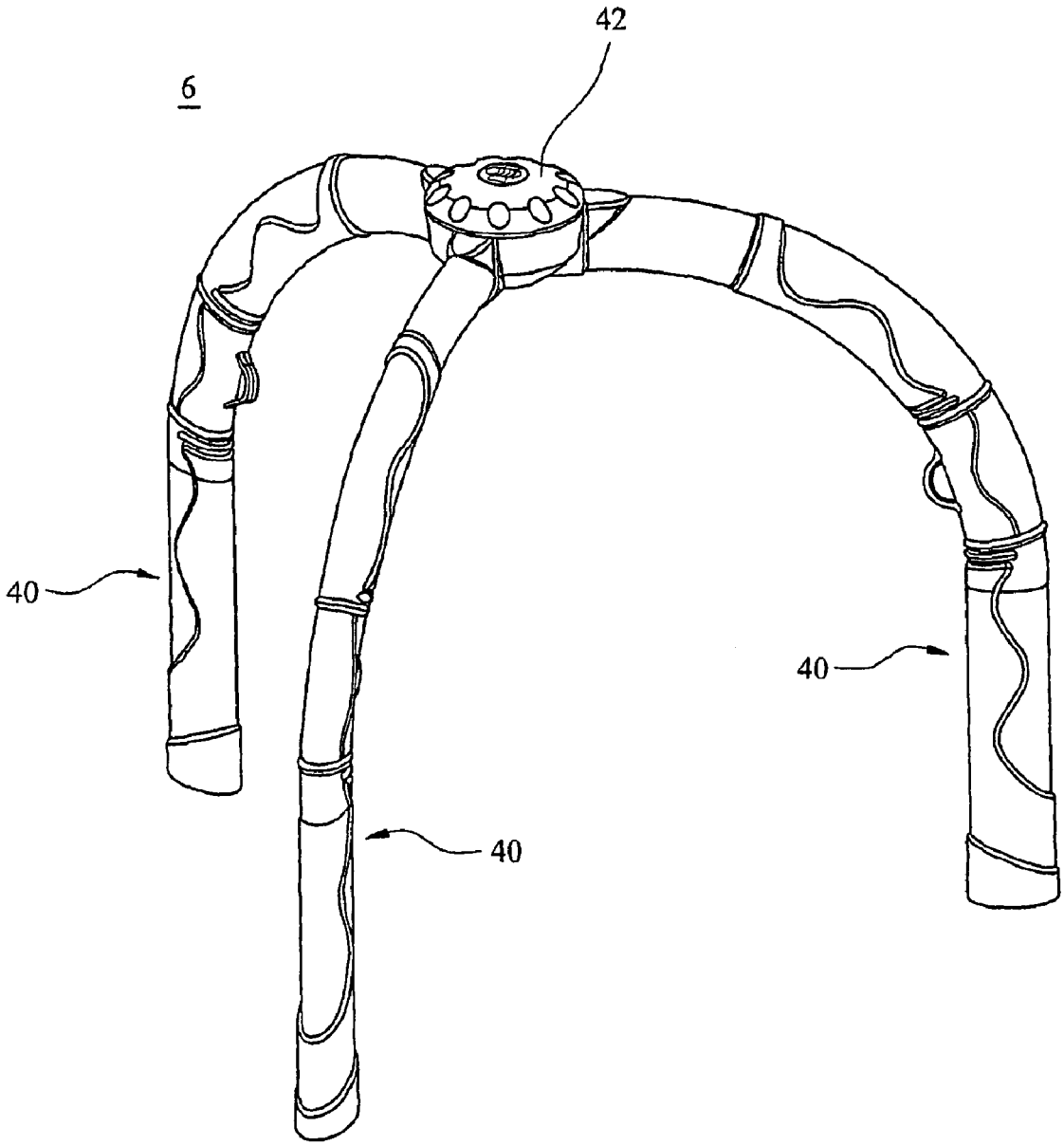
FIG. 10 is a perspective view of the frame in a fully assembled state.

Referring to FIGS. 8 to 10, the framework 6 is in the form of a tripod defined by three legs 40 secured to a central boss 42. The boss 42 comprises a body 44 which includes three radially extending, at 120° intervals, key-hole shaped sockets 46 which are arranged to slidably engage correspondingly shaped ends 48 defined at respective ends of upper leg members 50. The body 44 includes an internally screw-threaded upwardly open central socket 52 which is arranged to engage a screw-threaded bolt 56 which extends centrally from an underside face of a securement plate 58. The plate 58 is arranged to be engaged with body 44 for securing the ends 48 of the three leg members 50 to the boss 42.

Each leg 40 includes an upper curved leg member 50 having respective ends 48 and a substantially oval-cross-section end 60 which is arranged to be engaged in leg sleeve member 62 which comprises an oval-cross-section tube. A lower curved leg member 64 includes an oval-cross-section end 66 which is arranged to engage sleeve member 62. Thus, each leg 40 includes members 50, 62 and 64 which are arranged to be releasably slideably engaged with one another.

Members 50, 62 and 64 and boss 42 of the framework are made from a rigid plastics material which does not significantly bend under normal loads. Thus, the framework 6 is strong and supportive. It may support a range of stimulation means for stimulating an infant. In some cases, stimulation means may be fixed between two or three of the leg members 50 using hook and eye (e.g. Velcro) fastenings. This could be used to position the stimulation means towards the top of the framework. Alternatively and/or additionally, stimulation means may be secured to hooks 70 provided on each sleeve member 62 or stimulations means may be secured to two or three hooks 70 and extend therebetween. Nevertheless, it should be appreciated that the framework is arranged such that stimulation means may be arranged in numerous positions so that an optimum position may be selected for stimulating an infant arranged within infant accommodation region 7.

An alternative framework for use with the support device 4 may be as described in GB2318050.

Figure 11A:
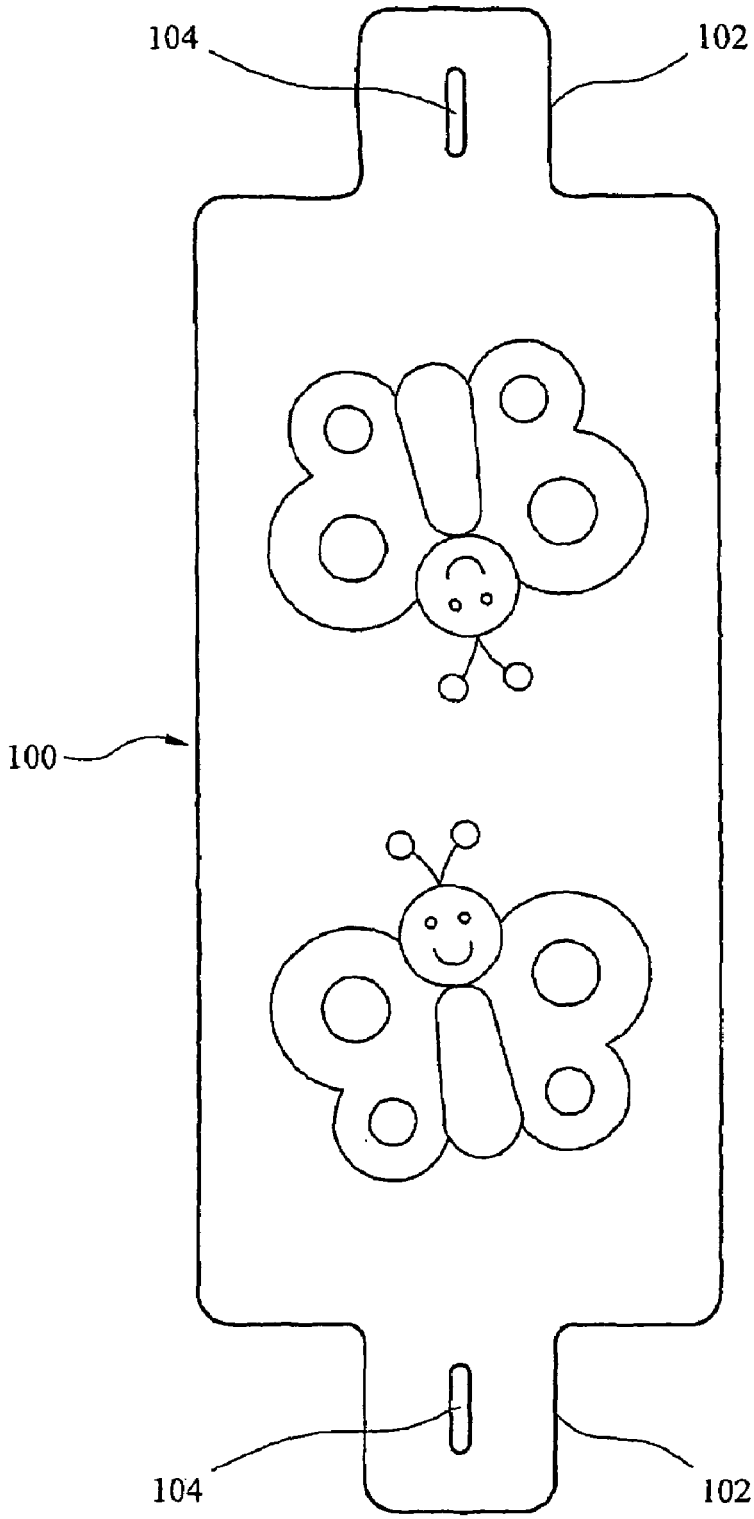
FIGS. 11*a* and 11*b* are a plan view and a side view respectively of a fabric sleeve.
Figure 11B:
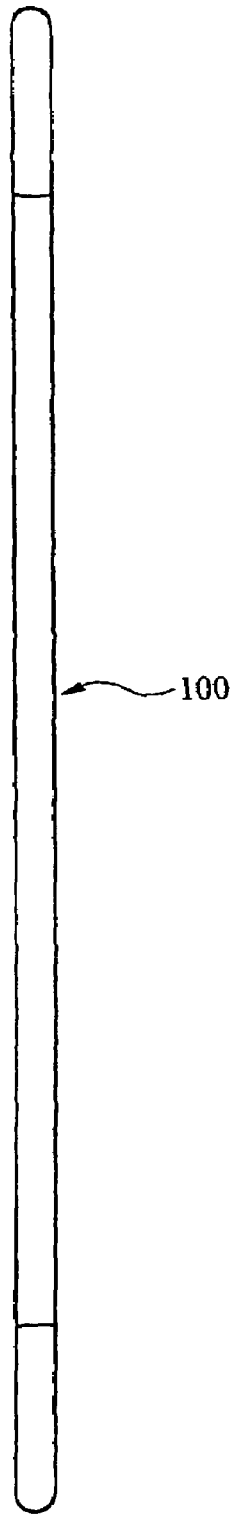
Figure 12:
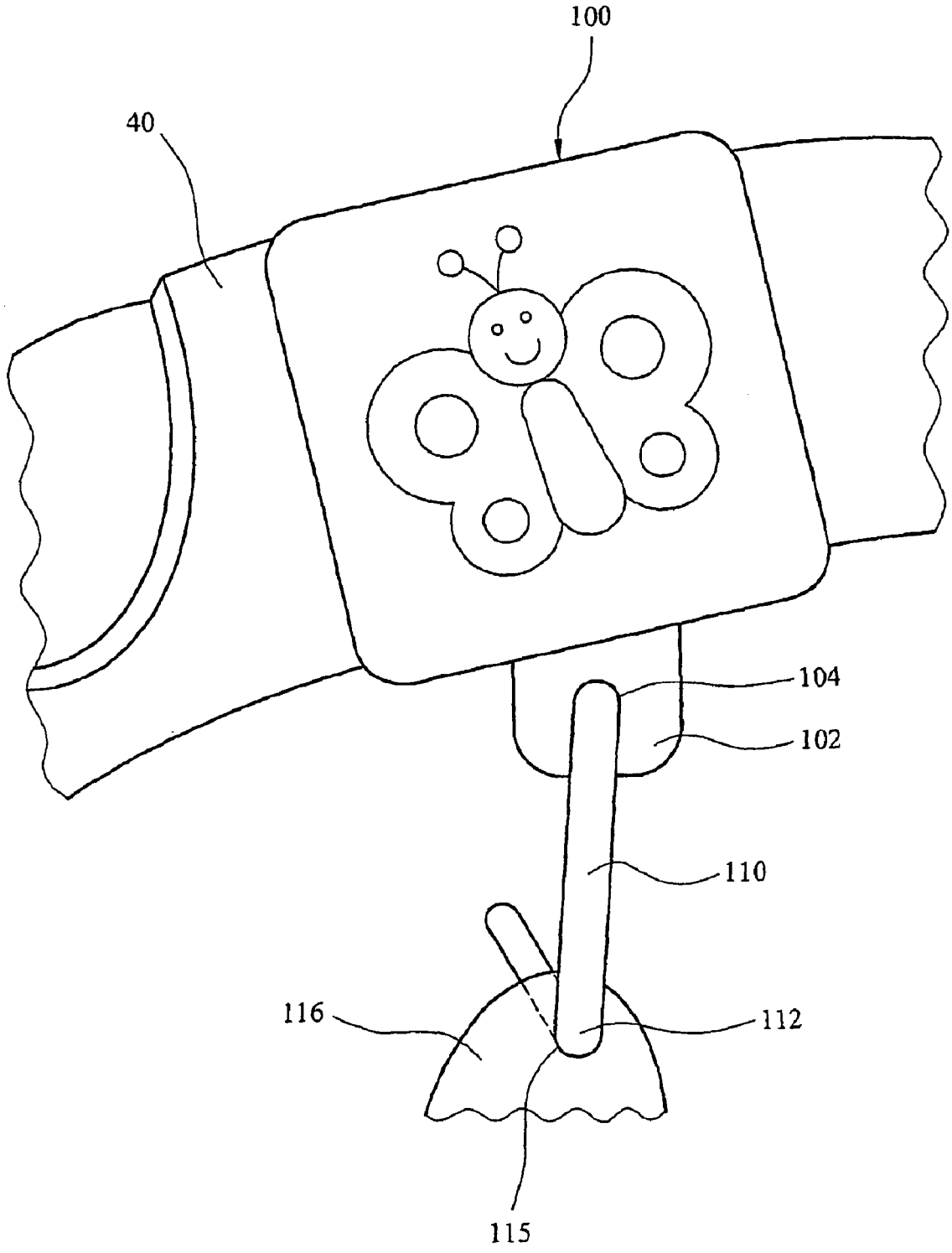
FIG. 12 shows the fabric sleeve secured to the framework.

A specific example of how a stimulation means may be secured in position is illustrated in FIGS. 11 and 12. Referring to FIG. 11 a fabric sleeve 100 is generally rectangular and has two tabs 102 at opposing ends, wherein the tabs 102 include elongate openings 104. The fabric sleeve is decorated with an attractive design. Referring to FIG. 12, the sleeve 100 is shown positioned around a leg 40 of the framework with respective tabs 102 and their associated openings 104 being superimposed. A hook 110 extends through the superimposed openings 104 and hangs downwardly and thereby serves to hold the tabs 102 together and to secure sleeve 100 in position on the leg 40. When so arranged, the sleeve 100 remains in position (and does not slide under gravity) due to friction between it and the leg 40. At its lower end 112 the hook 100 is arranged upwardly to define a hook element which can be engaged in an opening 115 in a toy 116.

Figure 2:
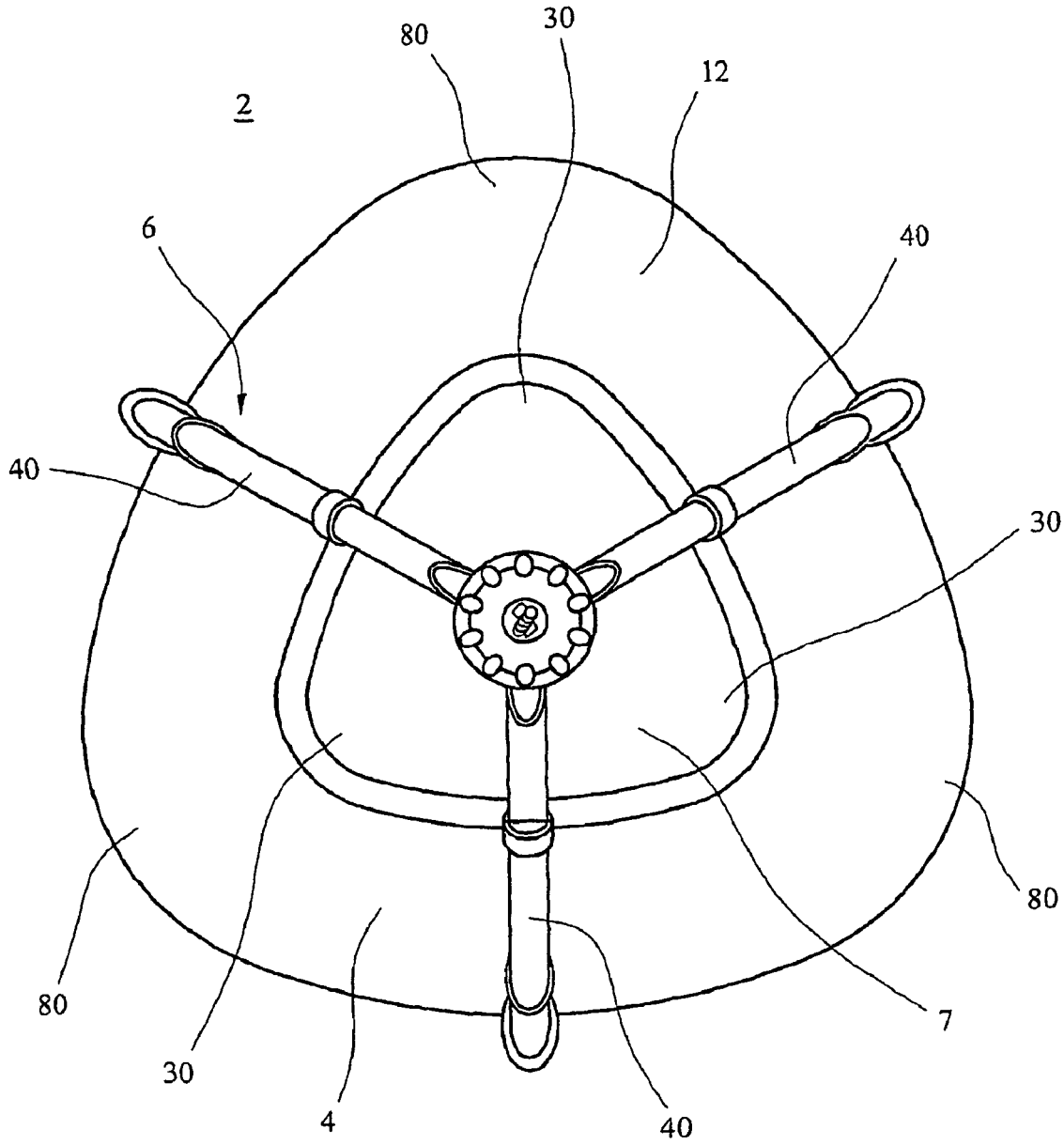
FIG. 2 is a top plan view of the apparatus of FIG. 1.

The framework 6 cooperates in use with support device 4 as shown in FIGS. 1 and 2. More particularly, legs 40 are arranged adjacent regions which extend between the apex regions 80 (FIG. 2) of the support device. Since the framework 6 is self-supporting it need not be secured to the support device 4. Once positioned as described, an infant can easily be positioned with its head/shoulders on one of the apex regions 30 and stimulation means associated with the framework 6 suitably positioned to stimulate the infant.

Thus, the infant accommodation apparatus described can be made relatively cheaply; can be assembled and inflated easily; provides a sturdy assembly; allows an infant to be easily positioned within it in a safe, supportive environment; and allows stimulation means to be arranged in numerous positions for stimulating and interacting with the infant.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. Infant accommodation apparatus supported in normal use on a flat horizontal surface, the apparatus comprising a support device having, in a vertical plane, a constant circular or oval-shaped cross-section along its extent, said support device including an inner enclosure wall which is defined by means of an inflated member, wherein said inner enclosure wall is an inwardly facing upstanding enclosure wall which defines an infant accommodation region in which an infant may be positioned in use, wherein said inner enclosure wall is endless and defines an endless non-circular enclosure around the infant accommodation region, wherein the maximum diameter of the infant accommodation region is in the range 20 to 50cm, wherein said inner enclosure wall includes, when viewed from above, three curved apex regions separated by curved side regions, said support device further including an outer enclosure wall which is an outwardly facing upstanding enclosure wall, wherein said outer enclosure wall is, when viewed from above, non-circular and symmetrical about each of three vertical planes angled at 120° to each other, wherein said support device has first and second maximum diameters, being the two largest distances across the support device, said first and second maximum diameters extending in respective first and second horizontal directions, wherein said first and second directions extend at an angle in the range 110 to 130° to one another and wherein said support device has a third maximum diameter which is the third largest distance across the support device, wherein said third maximum diameter extends at an angle in the range 110 to 130° to each of said first and second directions, wherein said first maximum diameter is in the range 70 to 100cm, said second maximum diameter is in the range 70 to 100cm and said third maximum diameter is in the range 70 to 100cm.

2. Apparatus according to claim 1 which includes a frame means extending above the support device for visually stimulating an infant positioned in the infant accommodation region, wherein said frame means includes at least three limbs extending upwardly from the support device.

* * * * *